US007059801B2

(12) United States Patent
Snyder et al.

(10) Patent No.: US 7,059,801 B2
(45) Date of Patent: Jun. 13, 2006

(54) METAL PLATE REINFORCED PLASTIC TROWEL BLADE FOR POWER TROWELING

(75) Inventors: Jeffrey L. Snyder, York, PA (US); George F. Wagman, III, Seven Valleys, PA (US)

(73) Assignee: Wagman Metal Products, Inc., York, PA (US)

( * ) Notice: Subject to any disclaimer, the term of this patent is extended or adjusted under 35 U.S.C. 154(b) by 0 days.

(21) Appl. No.: 11/015,073

(22) Filed: Dec. 17, 2004

(65) Prior Publication Data

US 2005/0141962 A1 Jun. 30, 2005

Related U.S. Application Data

(60) Provisional application No. 60/530,896, filed on Dec. 22, 2003.

(51) Int. Cl.
*E01C 19/22* (2006.01)

(52) U.S. Cl. ..... 404/112

(58) Field of Classification Search ..... 404/112, 404/118; 15/235.4
See application file for complete search history.

(56) References Cited

U.S. PATENT DOCUMENTS

| | | | | | |
|---|---|---|---|---|---|
| 2,556,983 | A | * | 6/1951 | Root | 404/112 |
| 2,662,454 | A | * | 12/1953 | Whiteman | 404/112 |
| 2,865,269 | A | * | 12/1958 | McMillan | 404/112 |
| 3,375,766 | A | * | 4/1968 | Zochil | 404/112 |
| 3,683,761 | A | * | 8/1972 | Babic | 404/112 |
| 4,316,302 | A | | 2/1982 | Clark | |
| 4,723,869 | A | | 2/1988 | Dragich | |
| 4,848,959 | A | * | 7/1989 | Morrison | 404/112 |
| 4,859,115 | A | * | 8/1989 | Morrison | 404/112 |
| 4,926,519 | A | | 5/1990 | Podlesny et al. | |
| 5,406,671 | A | | 4/1995 | Green | |
| 5,580,608 | A | | 12/1996 | Capoccia | |
| 5,607,256 | A | | 3/1997 | McCleary | |
| 6,491,162 | B1 | | 12/2002 | Barham | |
| 6,857,815 | B1 | * | 2/2005 | Allen et al. | 404/75 |
| 2003/0231930 | A1 | | 12/2003 | Allen et al. | |

OTHER PUBLICATIONS

1999 Wagman Metal Products Catalog, Dec., 1998 (45 pages).

* cited by examiner

*Primary Examiner*—Gary S. Hartmann
(74) *Attorney, Agent, or Firm*—Stuart J. Friedman

(57) ABSTRACT

A trowel blade for use with power trowels includes a plastic trowel blade having a reinforcing metal plate affixed to and overlying at least a portion of one face thereof. The blade is adapted for use in combination with a power trowel having a rotor including a plurality of rotor arms for mounting trowel blades thereon.

24 Claims, 4 Drawing Sheets

METAL PLATE REINFORCED PLASTIC TROWEL BLADE FOR POWER TROWELING

CROSS-REFERENCE TO RELATED APPLICATIONS

This is a non-provisional application based upon U.S. provisional application Ser. No. 60/530,896, filed Dec. 22, 2003, now pending.

FIELD OF THE INVENTION

The present invention relates to trowel blades for cast-in-place flooring and, more particularly, to metal plate reinforced plastic trowel blades for power troweling.

BACKGROUND OF THE INVENTION

The traditional floor finishing process for providing a smooth dense floor typically associated with interior cast-in-place concrete, terrazzo, epoxy or co-polymer flooring involves using hand or mechanical power troweling. Power troweling machines are available in two basic styles: walk-behind and ride-on. These machines have, historically, been fitted with various types of steel blades or, more recently, plastic blades, for different aspects of the finishing process.

Most walk-behind power trowels include a single set of horizontal rotating blades encircled by a guard ring cage, a gas or electric engine and a handle for machine control and steering. The blades are attached to radially extending, spaced apart arms of a spider assembly or rotor, which is caused to rotate by a shaft driven by the engine. Each rotor typically mounts three- or four-blades and has a diameter ranging from 2 to 5 feet, giving a finished area per revolution of slightly more than 3 to almost 20 square feet. A typical 36-inch diameter walk-behind power trowel can finish 7000 to 15,000 square feet of concrete per day. Since walk-behind power trowels weigh less than ride-on trowels, they can be put on slabs sooner than their heavier counterparts. Even so, concrete needs to be a bit harder before power troweling than hand troweling.

Configured with either two or three sets of rotating blades, typical ride-on power trowels range in size from approximately 6 feet to slightly more than 10 feet in path width, to produce a troweled area of about 17 to 40 square feet, respectively. The largest units weigh more than a ton and can finish about 30,000 square feet per day. Ride-on trowels can be configured with two or more rotors, each having a plurality of radially oriented, spaced-apart blades. The blades on adjacent rotors may be overlapping or non-overlapping. Overlapping blades are spaced so that each set of blades overlaps slightly with the other set as the blades rotate. Because the two sets overlap, no unfinished concrete is left between them, as is the case with a non-overlapping configuration.

There are three basic types of blades for both walk-behind and ride-on trowels: float, finish and combination. Float blades are normally about ten inches wide and are intended to run flat on the concrete shortly after the concrete has been poured and screeded. The blades, which have their leading edges turned up slightly so that fresh concrete won't be damaged, push aggregate down into the concrete and bring water to the surface. Finishing blades are used after floating is completed. They, typically, are rectangular in shape with the opposite long sides serving as the finishing edges. About six inches wide, they are pitched during use to apply more pressure to the concrete than with float blades, so that the surface can be compacted. The pitch angles for finishing blades are increased slightly on each successive pass to put increasingly greater pressure on the concrete surface. If the blades are pitched too much, a washboard effect may result, necessitating reducing the blades' pitch and refinishing the surface. Combination blades can both float and finish. They are, typically, about 8 inches wide, and are a combination of floating and finishing blades. They have a finishing edge and a float edge, are normally wider than finishing blades but narrower than float blades, and are more expensive than either finishing or floating blades. Combination blades are popular because operators don't have to stop and change the blades on each rotor for each operation. Their disadvantage is that they are not as efficient at either floating or finishing as the blades designed specifically for these jobs. One edge of the combination blade is pitched upwardly for floating, the pitched edge allowing fresh concrete to flow under the blade during floating, and the opposite edge is flat for finishing.

Mounting systems for mounting the blades, whether float, finish or combination, to the trowel arms on the rotors vary. In many systems, blades are bolted directly to the trowel arm. In other systems, the blades are connected to a mounting bar and the bar is bolted to the trowel arm.

During the final stage of finishing, a finish or combination blade is used to provide a smooth, dense finish. During this stage, burnish marks can occur on the finish, which are generally caused by the steel from which these blades have historically been made. In the past, to avoid these burnish marks, power troweling would have to stop and hand finishing would have to be used to complete the finishing process, which is both time and labor intensive. One relatively recent solution to the burnishing problem has been substituting plastic for steel as the material for the finishing blades. However, in most instances, the plastic blades are not strong or rigid enough to finish the concrete floor to an optimum level. Moreover, plastic blades can only be used on walk-behind trowels, as the ride-on trowels are much too heavy for the plastic blades.

Accordingly, there still exists a need for a stronger, more rigid blade that can be used on both styles of power trowels while also providing a burnish-free finish for many different types of floor systems.

SUMMARY OF THE INVENTION

It is, therefore, a primary object of the present invention to provide a trowel blade capable of providing a burnish-free finish for many different types of floor systems and which is suitable for use with both walk-behind and ride-on power trowels.

It is also an object of the present invention to provide a trowel blade capable of providing a burnish-free finish when used with power trowels which is simple to use and inexpensive to manufacture.

It is another object of the present invention to provide a metal reinforced plastic trowel blade which is capable of providing burnish-free finishes when used with both walk-behind and ride-on power trowels.

It is yet another object of the present invention to provide a plastic trowel blade having a metal plate affixed to and overlying at least a portion of one face thereof for providing reinforcement of the plastic blade sufficient for use thereof with ride-on trowels while, at the same time, contributing to the desired flexibility of the blade.

It is still another object of the present invention to provide a metal plate reinforced, elongate plastic trowel blade having an elongate mounting means extending longitudinally thereof and connected thereto for attachment to the trowel arm of a power trowel.

The foregoing and other objects are achieved in accordance with the present invention by providing a plastic trowel blade having a reinforcing metal plate affixed to and overlying at least a portion of one face thereof. The plate desirably overlies from 50% to 100% of the length of the blade and, preferably, from 70% to 100% of the length of the blade. Depending upon the thickness of the metal plate, the plate overlies from 33% to 100% of the width of the blade between the longitudinal centerline of the mounting means and each elongate edge of the blade, the thinner the plate the greater the overlap can be. In a preferred embodiment, the plate overlies from 55% to 70% of the width of the blade between the longitudinal centerline of the mounting means and each of the opposite elongate edges.

In another aspect of the invention, there is provided, in combination with a power trowel having at least one rotor arm for mounting a trowel blade thereon, a plastic trowel blade having a metal plate affixed to and overlying at least a portion of one face thereof and means for attaching said trowel blade to said rotor arm.

In still another aspect of the invention, there is provided, in combination with a power trowel having a rotor assembly including a plurality of arms extending radially outwardly from a central hub, a plurality of plastic trowel blades attached to said plurality of rotor arms, each said plastic trowel plate having a metal plate affixed to and overlying at least a portion of one face thereof, and means for attaching said trowel blades to said rotor arms.

DETAILED DESCRIPTION OF THE INVENTION

Figure 1:
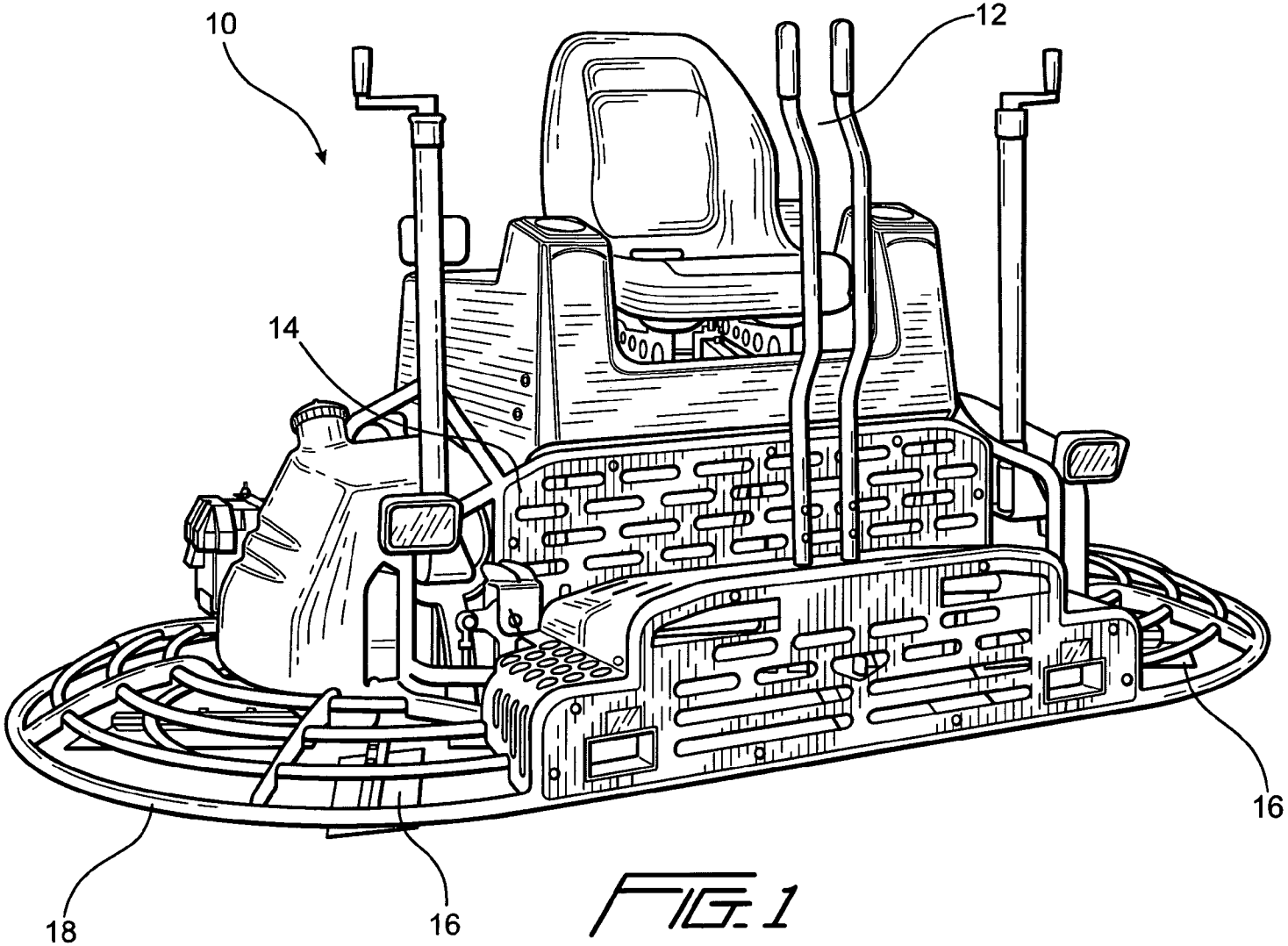
FIG. 1 is a perspective view of a ride-on power trowel.
Figure 2:
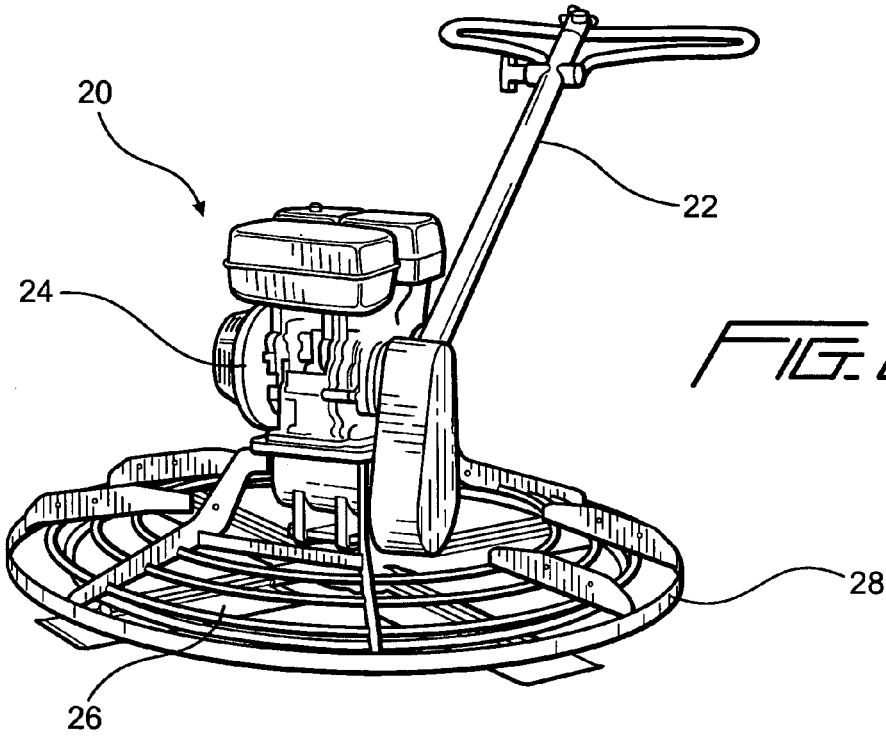
FIG. 2 is a perspective view of a walk-behind power trowel.
Figure 3:
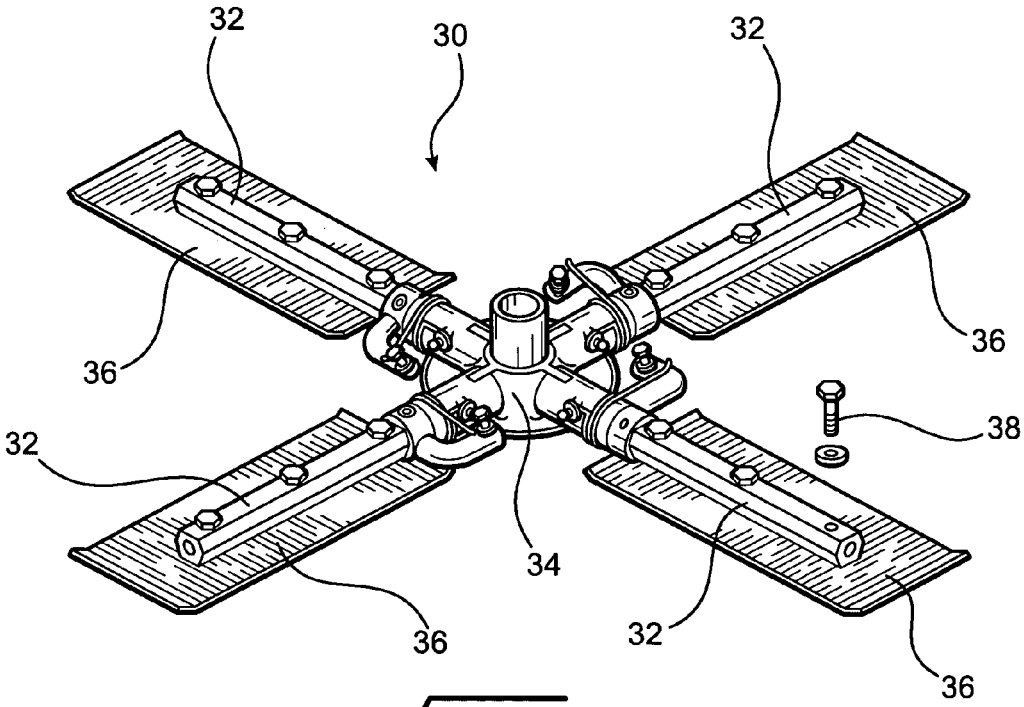
FIG. 3 is a top perspective view of a four arm rotor assembly mounting four trowel blades and suitable for use with ride-on and walk-behind power trowels.

The generally accepted technique for preparing a finished concrete surface proceeds through the steps of pouring, screeding, floating and finishing. The floating and finishing steps are typically accomplished, particularly on larger projects, using power trowels. Referring to FIG. 1 there is shown a conventional ride-on power trowel 10 comprising an operator seating and control station 12, an engine 14, at least two downwardly projecting rotor or spider assemblies 16, each assembly having a plurality of radially extending, spaced-apart arms and a trowel blade mounted on each arm for providing at least two sets of horizontal rotating blades encircled by a guard ring cage 18. FIG. 2 shows a conventional walk-behind power trowel 20 comprising a handle 22 for machine control and steering, an electric or gas engine 24, a single rotor or spider assembly 26 having a plurality of radially extending, spaced-apart arms and a trowel blade mounted on each arm for providing a single set of horizontal rotating blades encircled by a guard ring cage 28. A typical four arm spider assembly 30 suitable for use with either a ride-on or walk-behind power trowel is illustrated in FIG. 3. The assembly includes four radially extending arms 32 emanating from a central hub 34, which receives a drive shaft (not shown). A trowel blade 36 is mounted via bolts 38 on each trowel arm 32. It will be appreciated that each rotor assembly may contain more or less than four arms for mounting trowel blades thereon, the number of arms being a matter of design choice.

Figure 4:
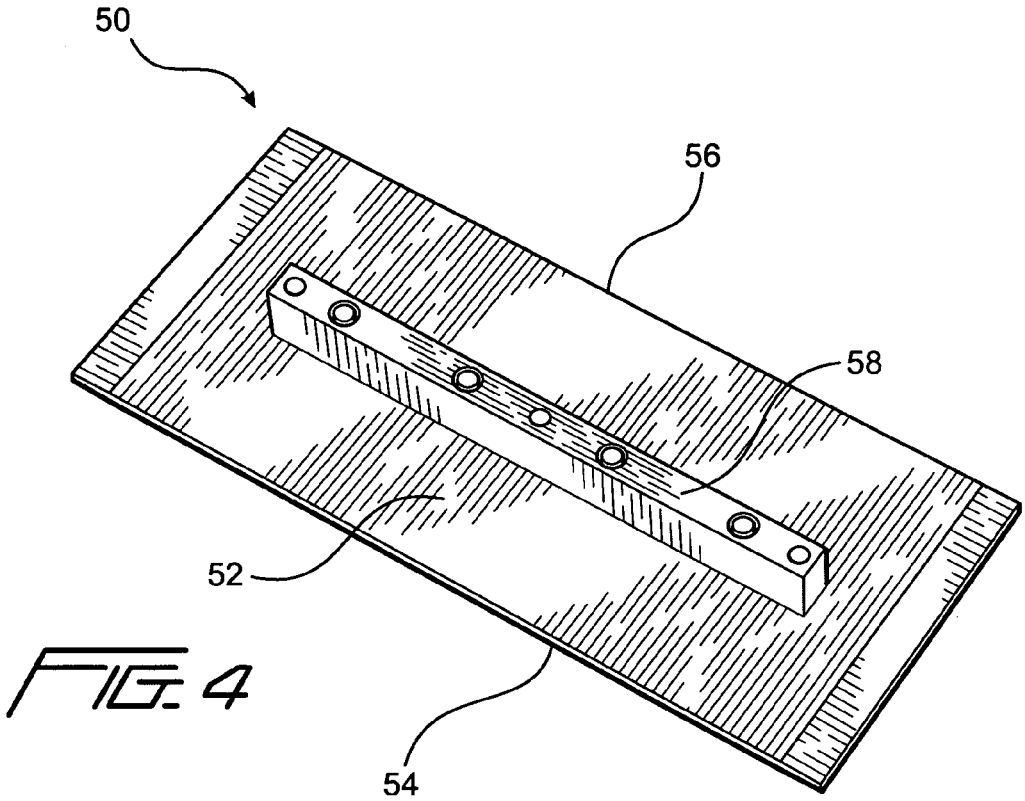
FIG. 4 is a top perspective view of a prior art finish trowel blade.
Figure 5:
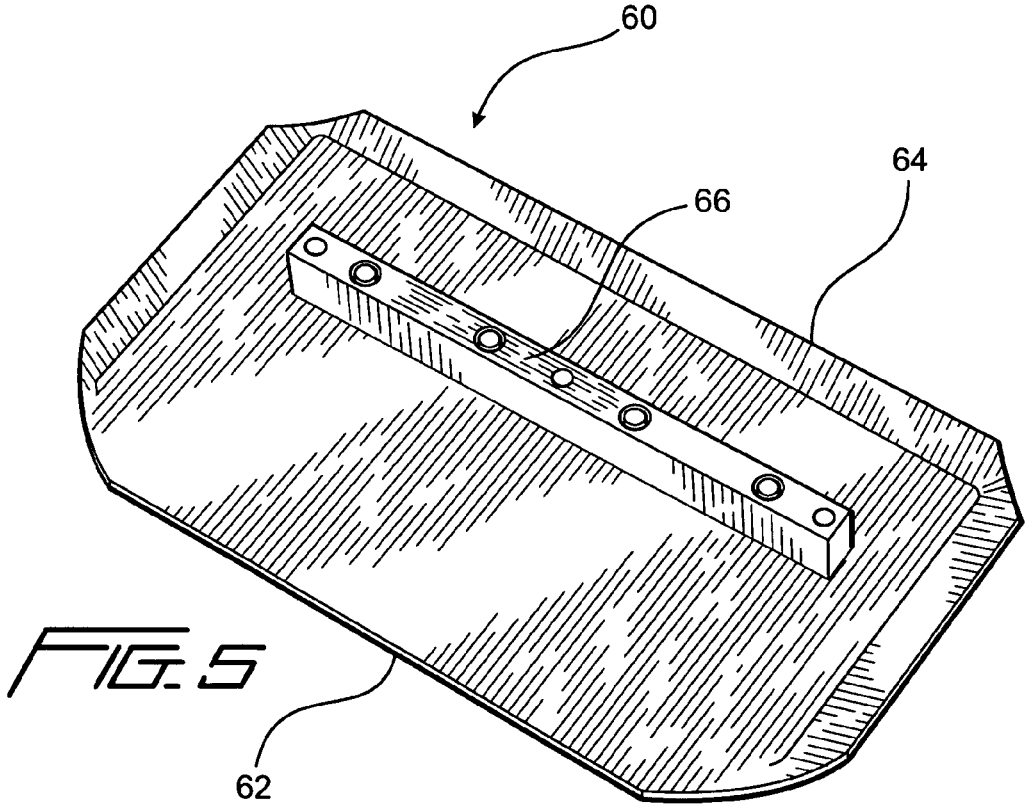
FIG. 5 is a top perspective view of a prior art combination trowel blade.

A conventional prior art finish trowel blade 50 is illustrated in FIG. 4. The blade 52 is generally rectangular and has two finishing edges 54, 56. Blade 52 is mounted to the trowel arm via a mounting means, which is attached to the blade and to the trowel arm. Illustrated here is a typical mounting bar 58, which is attached to the blade using screw fasteners and is bolted to the trowel arms. Finishing trowel blades are typically about six inches wide and, thus, are smaller than conventional float blades, which are generally used immediately following pouring and screeding in order to embed the aggregate in the concrete and bring water to the surface. As a result, finishing blades provide a greater pressure per square inch from the weight of the power trowel. Frequently, operators prefer not to use separate blades for floating and finishing in order to save the time required to change the blades on the spider arms of the power trowel. In such a case, they use combination trowel blades, which combine the function of float blades and finish blades. A typical prior art combination blade 60 is illustrated in FIG. 5. Combination blades are also generally rectangular, including a finishing edge 62 and a floating edge 64 and are mounted to a trowel arm via mounting means, such as mounting bar 66 via screw fasteners and/or bolts. They are narrower than float blades but wider than finish blades to permit them to perform their dual function. Their disadvantage, aside from their increased cost, is that they are not as effective at either floating or finishing as the blades specifically designed for those jobs.

Figure 6:
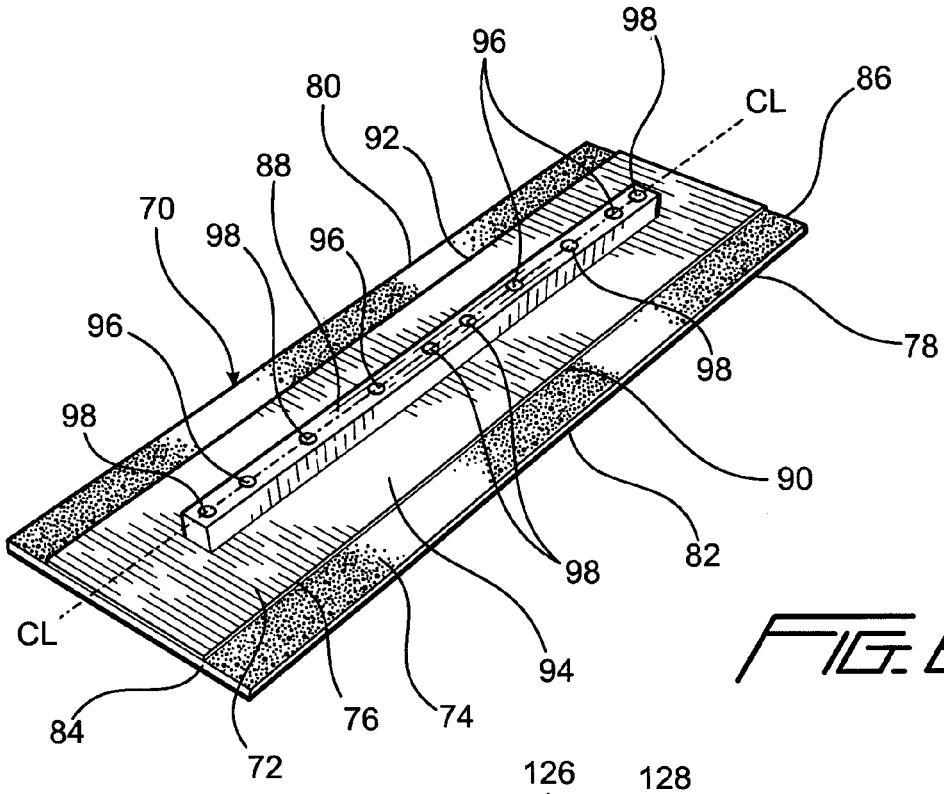
FIG. 6 is a top perspective view of a finish trowel blade of the present invention.
Figure 7:
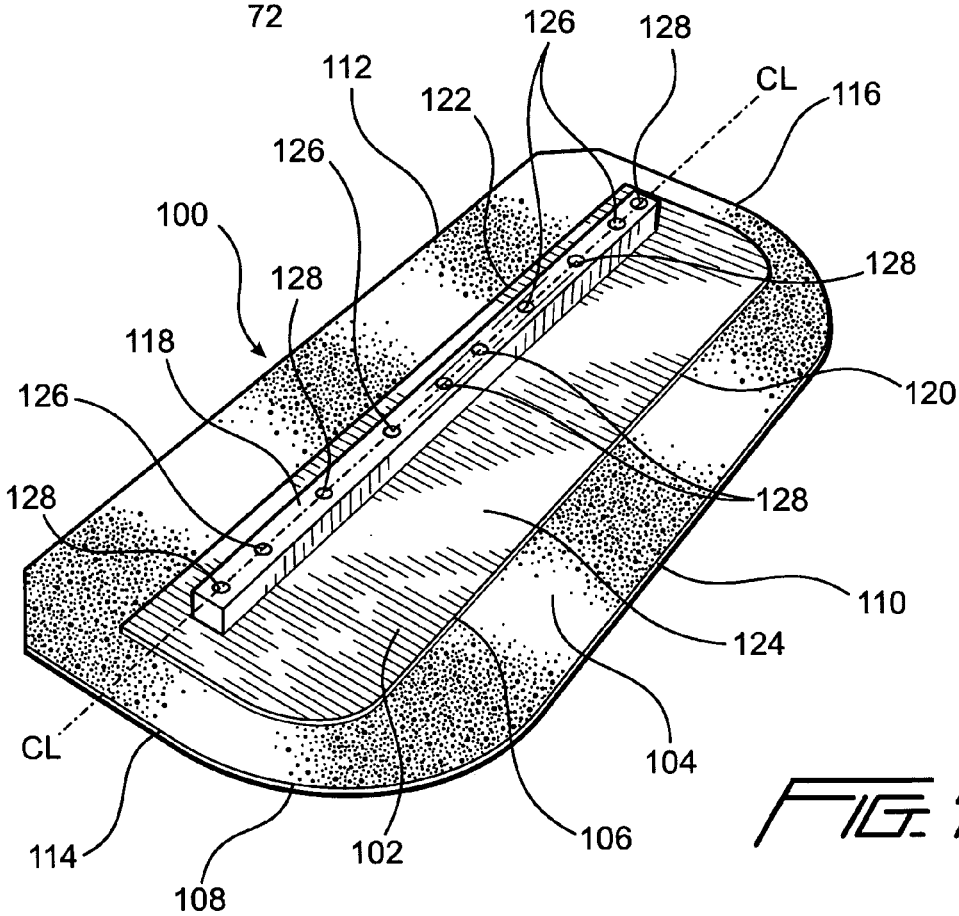
FIG. 7 is a top perspective view of a combination trowel blade of the present invention.

In accordance with the present invention, with reference to FIGS. 6 and 7, there is provided a plastic trowel blade 70, 100 having a metal reinforcing plate 72, 102 overlying a portion of one face of the blade, with face 74, 104 of blade 70, 100 in face-to-face contact with face 76, 106 of metal plate 72, 102. The other face 78, 108 of the blade frictionally contacts the concrete during finishing. Blade 70 (FIG. 6) is a finishing blade having two finishing edges 80, 82. Blade 100 (FIG. 7) is a combination blade having a finishing edge 110 and a floating edge 112. As previously stated, floating edge 112 is turned up or elevated above the base of the blade 100, for example, by beveling the underside of the floating edge 112 and, desirably, beveling the underside of the side edges 114, 116 as well. Trowel blades, such as finishing blade 70 and combination blade 100 are typically generally elongated and rectangular with opposite elongate edges constituting the working edge of the blades, and opposing sides or transverse edges 84, 86 and 114, 116, respectively, connecting the elongate edges.

Desirably, the plate 72, 102 overlies from 50% to 100% of the length of the blade 70, 100, wherein the length dimension is measured in the longitudinal direction of the blade 70, 100, i.e., between the side or transverse edges 84, 86 and 114, 116. In a particularly preferred embodiment, plate 72, 102 overlies from 70% to 100% of the length of the blade 70, 100 and the plate 72, 102 is centered between the side or transverse edges 84, 86 and 114, 116 of the blade. The width of the plate 72, 102 relative to the width of the blade 70, 100 depends upon the thickness of the plate 72, 102 and affects the flexibility of the blade 70, 100. This flexibility is less important with float blades than with finishing blades and combination blades. During finishing, with either a finishing blade or a combination blade, the blade is pitched relative to the floor surface in order to apply increased pressure on the floor surface with the finishing edge of the blade in order to density the floor material, such as concrete. During this process, the blade should flex a small amount to prevent creating a washboard effect. Thus, measuring the width of the plate from the longitudinal centerline CL of the mounting means 88, 118 to each of the longitudinally extending edges 90, 92 and 120, 122 of the plate, and measuring the width of the blade from the centerline CL of the mounting means 88, 118 to each longitudinal edge 80, 82 and 110, 112 of the blade, the plate desirably overlies from 33% to 100% of the width of the blade on each side of the mounting means 88, 118, depending upon the thickness of the plate. If there is insufficient plate overlying the blade, the blade will be too flexible. On the other hand, extending the plate overlap to at or near 100% is generally undesirable, at least for a finishing edge, since, with use, a finishing edge abrades. If the edge of the plate is too close to the edge of the blade, at some time during its use, the plate edge, instead of the plastic blade edge, will contact the concrete. The thinner the plate, the greater the overlap can be. In a preferred embodiment, the plate overlies from 55% to 70% of the width of the blade on each side of the mounting means 88, 118.

Typically, the plate 72, 102 is affixed to the plastic trowel blade 70, 100 using conventional fasteners, such as screws. As can be seen in the Figures, in one embodiment of the invention, a mounting means 88, 118, such as a mounting bar, extends longitudinally along the upper face 94, 124 of plate 72,102, preferably centered between the side or transverse edges 84, 86 and 114, 116 of the blade, and is affixed to the blade 70, 90 via screw fasteners extending through countersunk or counterbored apertures (not shown) in the underside 78, 108 of the blade, through the blade and into apertures 96, 126. In this connection, it has been noted that counterbored apertures in the blade underside 78, 108 allow the fastener to better grip the mounting means 88, 118 and prevents the mounting means from being pulled away from the plate when stressed during use. Additional apertures 98, 128 are provided in mounting bar 88, 118 for attaching the blade 70, 90 to the rotor arms of the power trowels using bolts, which extend through the rotor arms and are received in apertures 98, 128. It will be appreciated that the mounting means need not be a mounting bar, but can be any well known mounting means, such as a channel.

The metal plates are desirably formed of relatively thin, strong material. Typical plates may be formed of any metal having a hardness of Rockwell 30–60 HRC (this range includes metals ranging from cold rolled steel to a very hard heat-treated steel) and a thickness of 0.05–0.125 inches. In a preferred embodiment, the metal plate is formed of 3/32-inch thick 1075 grade high-carbon mechanical trowel steel with a Rockwell hardness of 42–44 HRC.

The plastic trowel blade is desirably formed of ultra high molecular weight polyethylene (UHMWPE) having a thickness in the range 0.25 to 0.5 inches, preferably about 0.375 inches. Desirably, the plastic will have a density in the range of about 0.93–0.96 gm/cm$^3$ and a tensile strength of about 3000 psi or higher. In addition, the plastic should have good abrasion resistance. UHMWPE which is suitable for use in the trowel blade of the present invention is available from Rochling Engineered Plastics under the trademark POLYSTONE M Natural. Another suitable plastic is available under the trademark SUSTARIN (Acetal Extruded) from Sustaplast Engineered Plastics of Edgewood, N.Y. Other plastic materials may be used in lieu of the preferred materials provided that they are chemically inert with respect to the metal reinforcing material and the flooring material, e.g., concrete, terrazzo, epoxy and co-polymer flooring, and exhibit the requisite hardness, strength, rigidity and abrasion resistance, together with the metal reinforcing plate, for providing a smooth, dense finish for traditional troweled floors.

While the present invention has been described in terms of specific embodiments thereof, it will be understood that no limitations are intended to the details of construction or design other than as defined in the appended claims.

The invention claimed is:

1. A trowel blade for power trowels comprising a generally rectangular, elongate plastic trowel blade having two opposite faces, two longitudinally extending, opposite edges and two transversely extending side edges interconnecting the longitudinal edges, at least one of said longitudinal edges being a finishing edge, a metal plate affixed to and overlying at least a portion of one face of said trowel blade and an elongate mounting means on said metal plate arranged generally parallel to said at least one finishing edge for mounting said trowel blade directly to said power trowel, said metal plate overlying from 50% to 100% of the length of said plastic blade and from 33% to 100% of the width of said plastic blade between the longitudinal centerline of said mounting means and each longitudinal edge of said blade.

2. A trowel blade, as claimed in claim 1, wherein said metal plate overlies from 70% to 100% of the length of the plastic blade.

3. A trowel blade, as claimed in claim 1, wherein said mounting means is connected to said plastic trowel blade by first fasteners and is connected to said power trowel via second fasteners.

4. A trowel blade, as claimed in claim 1, wherein said metal plate overlies from 55% to 70% of the width of said plastic blade between the longitudinal centerline of said mounting means and each longitudinal edge of said blade.

5. A trowel blade, as claimed in claim 1, wherein said metal plate is centered on said plastic blade between the side edges thereof.

6. A trowel blade, as claimed in claim 1, wherein said mounting means is centered on said plastic blade between the side edges thereof.

7. A trowel blade, as claimed in claim 1, wherein said elongate mounting means is an elongate mounting bar.

8. A trowel blade, as claimed in claim 1, wherein said elongate mounting means is an elongate mounting bar and said metal plate and said mounting bar are centered on said plastic blade between the side edges thereof.

9. A trowel blade, as claimed in claim 1, wherein said metal plate has a thickness of from 0.05 to 0.125 inches.

10. A trowel blade, as claimed in claim 9, wherein said metal plate has a hardness of Rockwell 30–60 HRC.

11. A trowel blade, as claimed in claim 1, wherein said plastic blade is formed of ultra high molecular weight polyethylene.

12. A trowel blade, as claimed in claim 11, wherein said plastic blade has a thickness of from 0.25 to 0.50 inches.

13. In combination with a power trowel having a rotor assembly including a plurality of rotor arms extending radially outwardly from a central hub, a plurality of trowel blades mounted on said plurality of rotor arms, each said trowel blade comprising a generally rectangular, elongate plastic trowel blade having two opposite faces, two longitudinally extending, opposite edges and two transversely extending side edges interconnecting the longitudinal edges, at least one of said longitudinal edges being a finishing edge, a metal plate affixed to and overlying at least a portion of one face of said trowel blade and an elongate mounting means on said metal plate arranged generally parallel to said at least one finishing edge for mounting said trowel blade directly to said rotor arms, said metal plate overlying from 50% to 100% of the length of said plastic blade and from 33% to 100% of the width of said plastic blade between the longitudinal centerline of said mounting means and each longitudinal edge of said blade.

14. A power trowel, as claimed in claim 13, wherein said metal plate overlies from 70% to 100% of the length of the plastic blade.

15. A power trowel, as claimed in claim 13, wherein said mounting means is connected to said plastic trowel blade by first fasteners and is connected to said rotor arms via second fasteners.

16. A power trowel, as claimed in claim 13, wherein said metal plate overlies from 55% to 70% of the width of said plastic blade between the longitudinal centerline of said mounting means and each longitudinal edge of said blade.

17. A power trowel, as claimed in claim 13, wherein said metal plate is centered on said plastic blade between the side edges thereof.

18. A power trowel, as claimed in claim 13, wherein said mounting means is centered on said plastic blade between the side edges thereof.

19. A power trowel, as claimed in claim 13, wherein said elongate mounting means is an elongate mounting bar.

20. A power trowel, as claimed in claim 13, wherein said elongate mounting means is an elongate mounting bar and said metal plate and said mounting bar are centered on said plastic blade between the side edges thereof

21. A power trowel, as claimed in claim 13, wherein said metal plate has a thickness of from 0.05 to 0.125 inches.

22. A power trowel, as claimed in claim 21, wherein said metal plate has a hardness of Rockwell 30–60 HRC.

23. A power trowel, as claimed in claim 13, wherein said plastic blade is formed of ultra high molecular weight polyethylene.

24. A power trowel, as claimed in claim 23, wherein said plastic blade has a thickness of from 0.25 to 0.50 inches.

* * * * *